United States Patent [19]

Harms et al.

[11] Patent Number: 5,052,491

[45] Date of Patent: Oct. 1, 1991

[54] OIL TOOL AND METHOD FOR CONTROLLING PARAFFIN DEPOSITS IN OIL FLOW LINES AND DOWNHOLE STRINGS

[75] Inventors: Herbert L. Harms, Alden; Charles R. Moeckly, Britt, both of Iowa; Donald Reed; April A. Reed, both of Commerce City, Colo.; Peter A. Kaiser, New Castle, Wyo.

[73] Assignee: Mecca Incorporated of Wyoming, Britt, Iowa

[21] Appl. No.: 454,893

[22] Filed: Dec. 22, 1989

[51] Int. Cl.[5] ..... E21B 37/00; F17D 1/00

[52] U.S. Cl. ..... 166/304; 166/66.5; 137/13; 137/803; 210/222; 210/695

[58] Field of Search ..... 166/66.5, 304, 902; 137/13, 833, 803; 210/222, 695

[56] References Cited

U.S. PATENT DOCUMENTS

| | | | |
|---|---|---|---|
| 3,228,878 | 1/1966 | Moody | 166/304 |
| 4,265,754 | 5/1981 | Menold | 210/222 |
| 4,278,549 | 7/1981 | Abrams et al. | 210/695 |
| 4,367,143 | 1/1983 | Carpenter | 210/222 |
| 4,417,984 | 11/1983 | O'Meara, Jr. | 210/695 |
| 4,605,498 | 8/1986 | Kulish | 210/695 |
| 4,611,615 | 9/1986 | Petrovic | 137/809 |
| 4,711,271 | 12/1987 | Weisenbarger et al. | 137/807 |
| 4,808,306 | 2/1989 | Mitchell et al. | 210/222 |

FOREIGN PATENT DOCUMENTS

| | | | |
|---|---|---|---|
| 0590438 | 1/1978 | U.S.S.R. | 166/66.5 |

*Primary Examiner*—Bruce M. Kisliuk
*Attorney, Agent, or Firm*—Breneman & Georges

[57] ABSTRACT

An oil tool and method for controlling the accumulation of paraffin and deposits in downhole oil string and oil transmission flow lines is provided by employing at various locations in the downhole oil string or in the oil transmission flow lines a coupling device with an inside liner of a non magnetic material surrounded by a magnet and shield of a magnetic material. The preferred application employs at least two magnets having their north pole and south pole aligned in opposite directions held in place in relation to a magnetic outer shield or casing by a non magnetic restraining ring. The non magnetic inside liner or non magnetic section of flow line in combination with the magnetic shield or casing increases the magnetic field which in combination with the electrostatic differential in the materials in the coupling and oil line prevents and controls paraffin and other substances having the potential for clogging and blocking downhole oil strings and oil transmission flow lines used for the transmission of crude oil. The novel coupling may be either employed as a threaded coupling or as a covering to cover the non magnetic tubing spliced into existing flow lines at strategic locations to prevent the clogging of crude oil transmission lines. The method and oil tool prevent the clogging of downhole oil string casing and above ground flow lines by utilizing magnetic and dissipation of electrostatic forces to increase oil production while eliminating paraffin and scale build up in downhole well pipe and flow lines.

36 Claims, 6 Drawing Sheets

FIG. 13
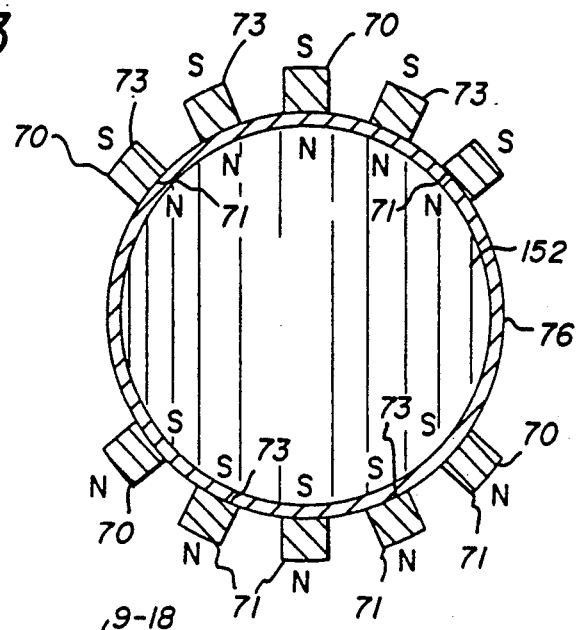
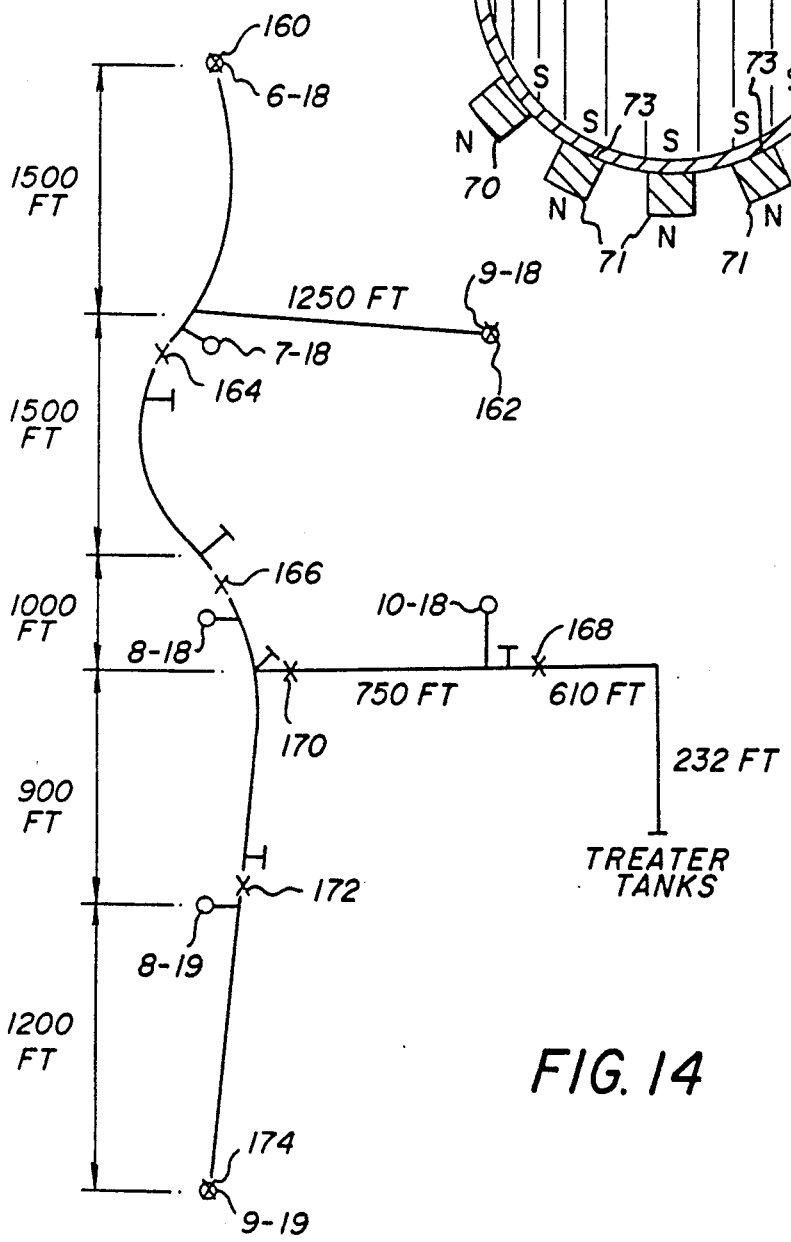
FIG. 14

OIL TOOL AND METHOD FOR CONTROLLING PARAFFIN DEPOSITS IN OIL FLOW LINES AND DOWNHOLE STRINGS

BACKGROUND OF THE INVENTION

1. Field of the Invention

The present invention pertains to a method and device for controlling and eliminating the deposition and build up of paraffin, salts and other scale sediments on the inside of downhole oil string lines and surface or subsurface oil flow transmission lines used for the transportation of crude oil. More particularly the invention relates to the utilization of a novel coupling device having a liner or a section of the conduit composed of a non magnetic and substantially non electrically conductive material surrounded by at least one magnet held in place by a restraining device and surrounded by a magnetic shield.

The oil tools of the invention may be employed in oil flow transmission lines or incorporated as a coupling in downhole oil strings. The utilization of the combination of a magnet and non magnetic and substantially non electrically conducted conduit disposed between sections of downhole oil string and oil flow transmission lines prevents paraffin and shale materials from depositing on the inside of the downhole oil string and surface flow lines without requiring expensive chemicals or extensive down time normally involved in the clogging or oil transmission lines. Paraffin clogging is particularly a problem in paraffin producing oil territories which is believed to result from a combination of magnetic and electrostatic forces resulting from friction in the flowing of oil in the oil conduit that contributes to the collecting of paraffin, salt and scale deposits on the inside of oil transmission lines.

2. Description of the Prior Art

Paraffin and paraffin clogging from deposits in crude oil has long been recognized as a problem in both pumping crude oil from the ground through the downhole oil string and in the transmission of crude oil through oil pipelines. A variety of mechanical, chemical, electrical heating and magnetic systems have been proposed in the prior art for removing paraffin or reducing the affinity of paraffin to deposit or combine with salt, shale, and result in paraffin clogging of crude oil conduits which as known by those skilled in the oil industry results in significant down time and problems in removing the plugging or clogging of downhole oil strings and above ground flow lines.

The prior art chemical systems for removing paraffin plugging of crude oil transmission lines are costly not only in terms of the amount of chemicals required to treat downhole oil strings and flow lines but also in terms of time in interruption of pumping and problems in the subsequent removal or the chemical solvents and the potential environmental impact of such chemicals. Typical chemical treatments for each oil well range from $150.00 to $600.00 per month per well and irrespective of the foregoing problems have been the procedures currently employed in the field due to cost effectiveness considerations.

As a result an effective mechanical system for removing or preventing paraffin clogging has been sought not only because of environmental considerations but also in view of cost effectiveness in terms of efficiency and the number of mechanical units that are required to maintain a given length of pipe. Unfortunately many of the prior art mechanical systems have not been effective in removing or preventing paraffin clogging or have required an unpractical number of units be placed in the oil transmission line for example every five to seventy five feet which make such systems unfeasible in view of cost and the number of units required and in view of space limitations in downhole oil strings which generally have outside diameters of 3 to 4 inches (7.6 to 10.2 cm) and may be as long as 25,000 feet. Other prior art electromechanical systems which involve heating are expensive to operate and maintain which has resulted in the predominant use of chemicals and hot oils and solvents.

Typically some of the prior art declogging systems employ hot oil, hot water or chemical solvents that are pumped through or back down the downhole oil string to force paraffin clogs back through the downhole oil string casing or through above ground flow lines to remove clogs and accumulations of paraffin, salt and paraffin scale deposits on the inside of the crude oil line from which the crude oil flows. These prior art systems result in substantial down time and costs in terms of heating a sufficient amount of water or oil necessary to melt and dissolve paraffin clogged lines as a result of their length and surrounding environmental conditions of the downhole oil line or the surface or buried oil flow transmission lines. Representative of prior art providing for a paraffin controlled coupling with the introduction of hot oil or other solvent for the removal of paraffin from clogged lines is U.S. Pat. No. 3,085,629. Consequently in recent years chemicals have been preferred in view of their effectiveness and cost ratio in terms of down time.

Chemical or solvent systems while effective and widely utilized in the industry are nevertheless costly and present environmental problems in the removal and disposal of the chemical solvents or agents. As a result a number of other mechanical, electrical and magnetic systems have been proposed for the removal or reduction of the amount of paraffin deposits resulting from the transmission of crude oil. The most pertinent prior art system known pertaining to preventing the buildup of paraffin by attempting to control electrostatic forces by the insulation of the pump and tubing from the well casing and the ground attributes paraffin accumulates in oil wells as a result of the actions of electric currents resulting from friction between the moving parts of the well pumping machinery. In U.S. Pat. No. 2,368,777 the friction problem is solved by insulating ground with non conductive washers at such points and in such a manner as to prevent the flow of electric current between the parts and the earth. As such various insulation sleeves and washers are provided between the pumping apparatus and the downhole oil string to reduce the effects of friction and the electrostatic forces which are believed to charge particles in the flow line and cause them to deposit on the inside of the crude oil conduit.

U.S. Pat. No. 2,368,777 does not utilize a special coupling in the oil flow line to dissipate and prevent the building up of the electrostatic forces resulting from the flow of crude oil in flow lines or prevent the deposition of paraffin inside above ground flow lines. U.S. Pat. No. 2,368,777 furthermore does not utilize magnets or the combination of materials of different conductivity and magnetivity in accordance with the present invention for the purpose of not only dissipating frictional forces along the section of the pipe but also to magnetically charge the particles of the constituents of crude oil flowing inside the pipe so as to prevent the subsequent deposition of paraffin, salts and paraffin scale deposits further along the downhole oil string or thereafter in the above ground pipeline or flow line.

U.S. Pat. No. 3,222,878 represents the closest prior art uncovered which pertains to the use of magnetic forces for the purposes of controlling the build up of paraffin deposits in above ground flow lines. U.S. Pat. No. 3,222,878 is not applicable to downhole oil lines in view of the size and arrangement of magnets. This patent appears relevant at first glance but is not particularly relevant to the present invention since U.S. Pat. No. 3,222,878 does not electrically isolate sections of pipe either along the downhole oil string or in surface or subsurface oil transmission flow lines and does not disclose a practical system in terms of practicability or in terms of economic feasibility.

U.S. Pat. No. 3,222,878 does not pertain to a downhole device for oil string lines but pertains only to a device for above ground oil flow lines to prevent the deposition of paraffin and diamagnetic deposits including scale since the arrangement of magnets having a radius of 4 5/16th of an inch could not be utilized downhole since it would not fit down inside an oil string casing which typically are 2 or 2½ inches (5.1 to 6.4 cm) in diameter. The above ground magnetic system of U.S. Pat. No. 3,222,878 furthermore does not electrostatically isolate sections of pipe and requires magnets disposed along the length of the pipe from about 10 to perhaps 150 times the length of the magnetic field. The length of the magnetic field described in U.S. Pat. No. 3,222,878 is produced from a magnet of about 5 15/16th of an inch (15.08 cm) in length which therefore would require repeating the installation of the arrangement of magnets every 5 to about 75 feet (1.5 to 22.9 meters) along the length of the pipe. Therefore even if such a mechanical system could be employed downhole it would be far in excess of the $150 to $600 a month per well and as a result of these and other problems such systems as U.S. Pat. No. 3,222,878 have generally resulted in the industry not accepting magnets and magnetic systems for the control of paraffin.

As a result there is a need for an effective, efficient and inexpensive system for preventing the deposition of paraffin and build up of paraffin, salt and shale combinations on the inside of oil string production lines and above and below ground flow lines that does not interfere with the oil production capabilities of existing wells. The reduction of crude oil production in high paraffin content wells is further compounded by the build up of paraffin in flow lines which require extensive and costly maintenance and have also raised environmental concerns over the elimination of solvents and other materials after dissolving paraffin from the oil lines.

The method of the invention and oil tools constructed in accordance therewith employ a combination of magnetic forces together with the isolation of sections of the crude oil conduits to break up the electrical conductivity and the propagation and build up of electrostatic charged in crude oil conduits by introducing a non magnetic and non electrically conductive liner surrounded by magnets along with a magnetic augmenting shield to magnetically charge crude oil constituents in oil conduits to provide an economically effective oil tools and method to prevent and remove paraffin and paraffin salt, shale combination on the inside of oil transmission pipes. The combination of the non magnetic substantially non electrically conductive liner of the novel oil tools and couplings together with magnets are believed to both disrupt the propagation of electrostatic forces that are believed to assist in the deposition of paraffin and paraffin combination deposits on the pipe wall while at the same time magnetically charging the particles to prevent their deposition on the downhole oil string or above ground flow line for distances of 1,200 feet (366 meters) or more utilizing magnets of about 1¾ inch in length (3.5 cm).

The novel oil tools constructed in accordance with the invention that employ a combination of magnetic and non magnetic materials together breaking up the propagation of electrostatic charges unlike the prior art provides for the disposition of magnets along the path of flow of about 6,000 times the dimension of the magnetic field. The method of the present invention therefore allows the disposition of magnets at 1,200 or more feet intervals as opposed to 75 feet intervals of the prior art and allows the device of the present invention to be utilized both in above ground in oil flow lines and below ground in downhole oil strings at an economically and environmentally attractive alternative to the utilization of chemicals, solvent or systems for heating oil, water, solvents or combinations thereof to remove and prevent clogging of crude oil conduits.

SUMMARY OF THE INVENTION

The disadvantages and limitations of prior art methods and devices for removing or preventing paraffin clogging in downhole oil string lines and surface or buried terrain flow lines are obviated by the utilization of the present method and oil tools for preventing the accumulation of paraffin, salts and scale deposits on the inside of oil conduits. The problem of friction in oil flow lines leading to static charges and paraffin build up and clogging of downhole oil string lines compounded by temperature differentials resulting from temperature variation in the earth strata as the oil is pumped up the oil string line is eliminated by the introduction of a coupling having a non magnetic or non conductive material forming an inner conduit surrounded by magnets interposed at various locations along the downhole oil string line and/or the above ground flow lines.

The method of the invention contemplates the strategic placement of a non magnetic and preferably non conductive section of pipe between conventional magnetic and conductive lines or pipe in combination with magnetic forces disposed around the non magnetic and non conductive material. The non magnetic and non conductive liner or section of conduit surrounded by a magnetic force in the preferred embodiment includes a magnetic shield or magnetic covering material which may interrupt the flow of electrostatic forces and act as a static drain to remove the effects of frictional static forces built up in the process of oil flowing in the oil conduit lines. It is believed the combination of non magnetic and non conductive section plus the utilization of magnets as a static drain for the disruption of electrostatic build up and the transmission of electrostatic charges that are believed to result in the eventual coagulation and disposition of paraffin, salt and scale that ultimately plugs up downhole oil string lines and terrain or subterranean oil flow lines.

The magnets together with the difference in the magnetivity and electrostatic conductivity of the liner of the coupling and the interruption in the static conductivity of the conduit may function as a static drain or means for the interruption and dissipation of the flow and build up of electrostatic forces that ultimately contributes to the plugging crude oil conduits. It is believed this interruption of the electrostatic could be provided with other types of static drains in combination with the non magnetic or non conductive section of the pipe to construct oil tools in accordance with the method of the invention.

In the preferred embodiment of the invention a combination of non magnetic and relatively poor conductive sections of pipe are interdisposed between the normally electromagnetic and conductive pipe sections of oil conduits in existing oil string lines and terrain flow lines to provide a break in the propagation and accumulation of electrostatic charges that are generated as a result of the flow of crude oil and oil products in oil conduits such as downhole oil string lines and above ground and buried flow lines. It is further believed the method and oil tools constructed in accordance with the invention may be effective in coacting the magnetic forces of the earth in combination with the non conductive sections of pipe to both remove and eliminate electrostatic forces generated and built up in the flowing of oil in oil conduits while at the same time magnetically charging particles in the flow line to prevent their aggregation, coagulation and bonding to charged sections of oil conduit pipes.

Paraffin control oil tools in accordance with the present method for controlling, preventing or dissolving the build up of paraffin, salt and scale deposits which block up and plug flow lines and downhole oil string lines result from the joining of sections of non magnetic and disparate non conductive lengths of pipe between conductive sections of pipe which further include one or more magnets disposed axially around the inside liner or section of a non magnetic and non conductive pipe that in the preferred embodiment may be surrounded by a magnetic augmenting shield or conduit pipe composed of a magnetic and conductive material. The combination of non magnetic and non conductive section of pipe in combination with the magnets and conductive shielding or surrounding conduit serve to not only dissipate electrostatic forces along the length of the conduit but also to magnetically charge the constituents of crude oil which prevent or control the coagulation and cohesion of paraffin, salt and scale deposits on the inside of crude oil conduit pipes.

The magnets are believed to charge crude oil constituent particles flowing through the crude oil conduits to augment the disruption of electrostatic forces which in combination to the magnetic susceptibility of particles passing through the flow lines prevent their subsequent coagulation and interferes with their attractive forces that results in the plugging of the flow lines and downhole oil string lines. It is believed the combination of the dissipation of the electrostatic forces and the charging of crude oil constituents results in the excellent and economical advantages provided by oil tools constructed in accordance with the invention to prevent paraffin clogging of downhole oil string lines and above ground and subterranean flow lines.

Devices constructed in accordance with the preferred embodiment of the invention for use in downhole oil string lines are couplings constructed of a coupling material having a suitable hang weight and preferably a hang weight of over 70,000 pounds such as J-55 and preferably in the range of 100,000 to over 200,000 pounds such as utilized in C-75, L-80, N-80, C-90 and P-105 which are industry standards for downhole oil string pipe and coupling material of the American Petroleum Institute from which downhole oil tools of the invention can be constructed. The novel oil tools can be constructed from these oil tool couplings by increasing the diameter of these couplings from about $\frac{1}{4}$ to $\frac{1}{2}$ inch to accept one or more magnets in a suitable magnet restraining device of a non magnetic material which surrounds a section of inside liner composed of a non magnetic and non conductive material. The standard couplings are generally about 9 inches long (22.9 cm) for pipe having about a $2\frac{1}{4}$ inch inside diameter (5.7 cm) or $9\frac{3}{4}$ inches long (23.8 cm) for pipe having an inside diameter of about $2\frac{5}{8}$ inch inside diameter (6.67 cm) although other lengths and other inside diameters may be utilized depending upon the inside liner of non magnetic and non conductive material may be either sealed with locking rings or the liner may be deformed into restraining grooves formed in the coupling to position the non magnetic, non conductive inside liner in the outside conductive pipe forming the body and conductive covering of the coupling.

The magnet cavity and magnets surrounding the inside liner are insulated from the crude oil flowing through the oil tool by the utilization of O-ring seals of rubber or other non conductive material to seal. The combination of magnets and inner liner are believed to operate by disrupting the resonance frequency in constituents of the crude oil flowing through the magnetic field which prevent them from attaching to the conduit or by polarizing the constituents, preventing seed material from coagulating or by removing and dissipating electrostatic forces. Oil tools constructed in accordance with the invention prevent the coagulation of paraffin and the accretion of paraffin on the inside walls of ordinary downhole oil string lines. The magnets cooperate with the non magnetic and electrically non conductive inside liner by assisting in the induction of electrical forces in constituents of the flowing crude oil such as paraffin and salt to assist in the elimination of the potential for clogging in the downhole oil string line. In the preferred embodiment of oil tools designed for use in the downhole oil string pipes at least two magnets and preferably six rectangular magnets having two layers, the top layer being for example the north pole and the bottom layer being the south pole with the magnets being axially displaced and their poles reversed around the circumference of the non magnetic and non electrically conductive inner liner to assist in the induction of magnetic forces in crude oil constituents flowing through the inside liner while assisting in the elimination of electrostatic forces propagated along the length of the downhole oil string.

Oil tools constructed for above ground or subterranean flow lines for the transportation of crude oil or oil products from the well head to a collection or refining facility employ the same principles as downhole oil tools except the oil flow line oil tools do not have to be made to withstand the hang weight requirements of couplings designed for downhole oil line use. In the preferred embodiment of flow line couplings in accordance with the invention a non magnetic conduit or tubing is either in place or is spliced into an existing magnetic or a static electrically conductive flow line. In either embodiment the non magnetic conduit is surrounded by one or more magnets backed with an electrically conductive or magnetic backing material to disrupt the propagation of electrostatic forces along the flow line and to increase the effectiveness of the magnetic inductive forces on crude oil constituent particles flowing through the above ground or subterranean flow line.

Oil tools for oil transmission flow lines constructed in accordance with the preferred embodiment are provided in the form of a sleeve of roughly 2 halves disposed around a non magnetic section of pipe in which preferably 8 or more rectangular magnets are maintained in each half of the sleeve having a steel backing of a magnetic and conductive material surrounded by an environmentally protective coating such as stainless steel that forms the housing for the 2 halves which may be joined together with bolts or other means for fastening the sleeve with respect to the above ground flow line or conduit. Preferably the magnets are rectangular magnets having two magnetic layers a top layer and a bottom layer disposed along the length of the magnets which magnets are arranged in the halves so that the north and south poles of the magnets are in axial non alignment to the direction of flow of crude oil and oil products in the flow line.

The combination of non magnetic inner liner or conduit in combination with the magnets and backing plate of a magnetic and conductive material are believed to focus and concentrate the lines of magnetic force on the crude oil constituents flowing through the section of non magnetic conduit which by interrupting the resonance frequency of the constituents of crude oil, polarization, disruption of the attractive forces in seed crystal materials or by the disruption of the electrostatic charges in flow lines prevent and disrupt the coagulation and subsequent clogging of the flow lines with paraffin, salt and scale combinations which ultimately plug existing flow lines.

The oil tool couplings or sleeves constructed in accordance with the invention can be placed at long distances along the length of the pipe and are effective in preventing and eliminating paraffin, salts and other scale producing elements in crude oil from clogging flow lines. The effectiveness of the combination of materials and magnets and their action on the flow of crude oil and oil products in the flow line to charge the particles allows the couplings to be placed every 1,000 feet (304.8 meters) or more to allow the system of the present invention to effectively compete with the least expensive chemical and solvent systems for declogging and preventing the clogging of crude oil flow lines and downhole oil strings.

The oil tools constructed in accordance with the invention are easily manufactured, require little or no maintenance and virtually have an unlimited life since the magnets utilized generally lose only about 5% of their efficiency in 100 years and therefore the novel tools once in place effectively reduce and prevent or unplug the flow lines or in downhole oil string for the life of the oil conduit. Oil tools constructed in accordance with the invention are furthermore economically constructed such that the general cost of the unit pays for itself in less than a year in cost of chemicals plus the novel oil tools do not impede the flow of crude oil, result in down time, pollute the environment, or require the removal of the chemicals from the crude oil in subsequent refining processes.

The magnetic non conductive and non magnetic combination not only prevents the formation of paraffin and clogging build ups within the pipeline but also efficiently and economically removes clogging in pipelines and oil flow lines used for the transportation of oil. The novel couplings of the invention may be utilized in both above ground or in subterranean flow lines as well as in downhole applications to reduce and prevent clogging of the oil flow lines.

The features of the invention reduce and eliminate the amount of oil pipe maintenance and flow line maintenance required for pipelines transmitting crude oil at a price and cost effectiveness better than the utilization of chemicals which can otherwise result to damage to the environment. Moreover as a consequence of the design and construction of novel oil tools of the invention they can be economically and conveniently manufactured and placed in downhole oil string lines and terrain and subterranean flow lines to reduce the problems of plugging and clogging of crude oil transportation lines while reducing the possibility of damage to the environment resulting from oil line breaks or the spilling of chemical solvents.

DESCRIPTION OF THE DRAWINGS

Other advantages of the invention will become apparent to those skilled in the art from the following detailed description of the invention in conjunction with the accompanying drawings in which:

FIG. 13 is a schematic view of a preferred arrangement of magnets around a magnetically non conductive oil conduit; and FIG. 14 is a schematic diagram illustrating an application of the oil tool of FIG. 6 to a crude oil flow line for controlling clogging.

DETAILED DESCRIPTION OF THE INVENTION

The present invention is applicable to all systems involving the transmission of crude oil from below the ground to its transportation to the refiner through terrain or subterranean flow lines to a storage facility. The invention employs slight variations in the oil tool depending upon whether the oil tool is utilized downhole in oil string or above ground in oil flow lines. Oil tools utilized in the downhole environment require considerations involving hang weight and adaptability of the outside diameter of the oil tool to the size and dimension requirements of the downhole oil string casing. Downhole oil string casing or lines are oil transmission lines or oil conduits designed for removing crude oil from its below ground environment to the above ground flow lines for ultimate transportation to storage containers or to the refinery.

Figure 1:
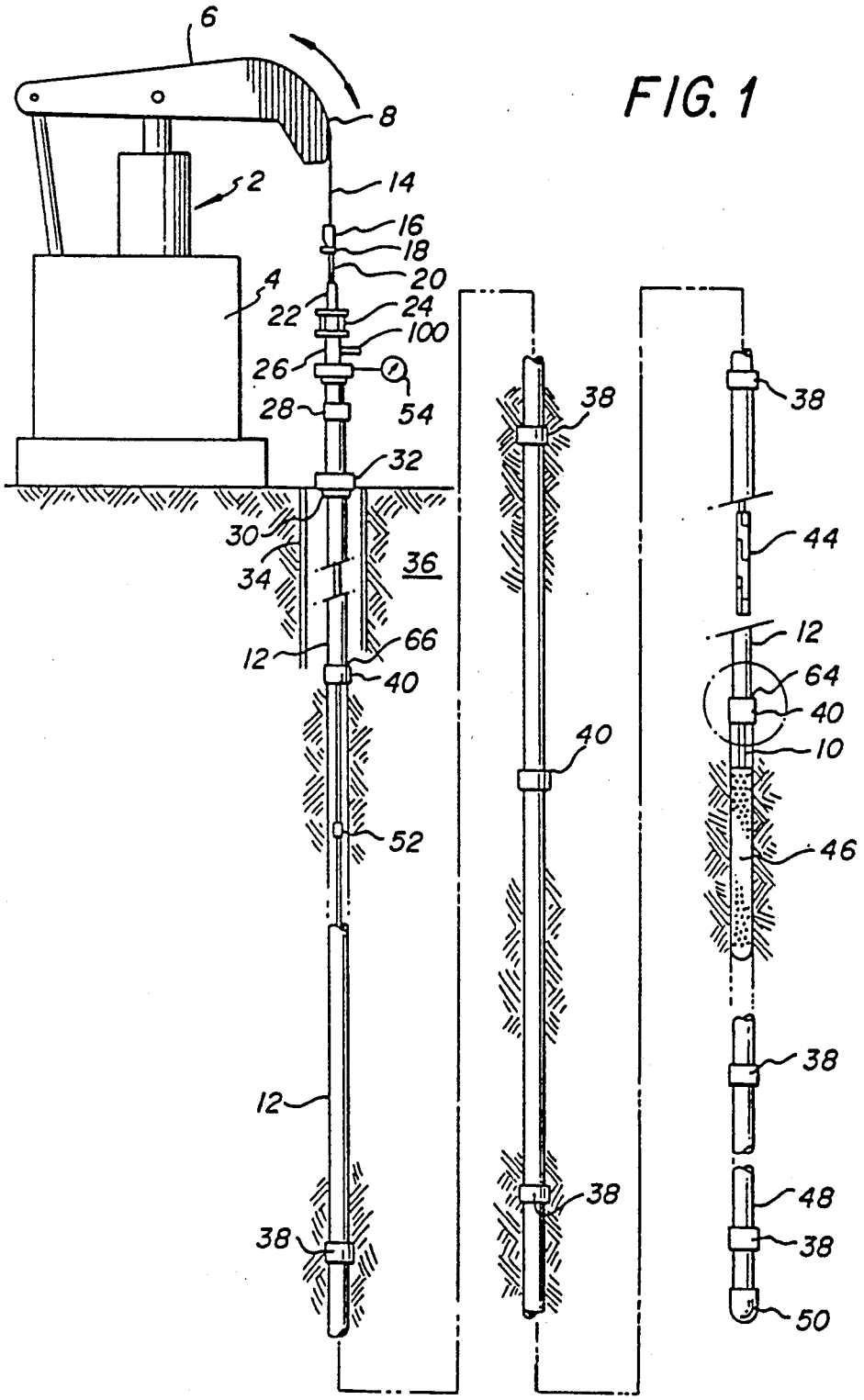
FIG. 1 is an elevational view partly in section of an oil well pumping unit and downhole oil string including novel couplings constructed in accordance with the invention.

Referring now to FIG. 1 a well known oil well extending below ground together with a typical pumping unit is illustrated having a standard above ground derrick 2 partly shown having a support means 4 bearing a walking beam 6 having a horsehead 8 for activating a sucker rod 10 in the downhole oil string casing 12 through a wire line 14. Wire line 14 is connected to sucker rod 10 through a standard polished rod clamp 16 and carrier bar 18 through polished rod 20 to the polished rod liner 22 to the stuffing box 24. A pumping tee 26 connects the stuffing box 24 with a pup joint 28 to the tubing head 30 which connects the downhole oil string casing 12 from its position above ground to its position below the surface of the earth.

The casing head 32 caps the surface casing 34 which provides a separation between the surrounding ground 36 and the downhole oil string casing 12. The downhole casing 12 predominantly employs downhole oil string pipes having an internal diameter of about 2 inches (5.08 cm) or 2½ inch (6.35 cm) that are threaded together through couplings. These sections of oil string pipe which form the downhole oil string casing have male threads at both ends and are connected utilizing standard couplings 38 for joining the sections of oil string casing 12 together. The oil tool 40 of the present invention are substituted for couplings 38 at various positions along the length of the oil string with the distances between the oil tool 40 depending upon the paraffin content of the crude oil. The oil tool 40 can be formed from a standard coupling composed of material of a suitable hang weight so that the outside surface 42 appears the same as the standard couplings 38 used in the oil string casing 12.

The standard coupling 38 for 2 inch (5.08 cm) inside diameter pipe is about 9 inches long (22.9 cm) and has an external diameter of about 3¾ inches (9.53 cm) while the standard oil tool coupling 38 used for 2½ inch downhole tubing is about 9⅜ inches long (23.83 cm) and has an external diameter of 3⅞ inches (9.86 cm). The standard coupling like the novel downhole oil tool constructed in the preferred embodiment includes internal threads at both ends for receiving the sections of oil string pipe which form the downhole oil string casing 12.

The oil tool 40 of the invention can be constructed from the standard coupling 38 and as a result has the same dimensions as coupling 38 and for all purposes substitute for the standard couplings 38 heretofore utilized to connect downhole oil string pipes. The novel oil tool 40 can therefore be connected to the oil string casing pipe at various locations in the downhole oil string to serve the dual function of performing as an ordinary coupling for joining sections of downhole oil pipe while at the same time serving to prevent paraffin and salt laden crude oil from scaling and clogging the inside of the pipe as it is drawn up through the oil string casing 12. The crude oil is pumped to the surface by the action of walking beam 6 and subsurface pump 44 (FIG. 1) through the perforated pup joint 46. The downhole drill string further includes a standard tubing and mud anchor 48 connected to a bull plug 50.

Crude oil containing paraffin, salts and other scaling and clogging materials is pumped to the surface through the perforated pup joint 28 through subsurface pump 44 through the oil string casing 12 by sucker rod 10 which itself is connected to the subsurface pump 44 through sections of the sucker rod connected with sucker rod couplings 52. The pumping action of the sucker rod coupled with the flow of crude oil through the oil string casing 12 is believed to generate electrostatic forces which depending upon the rates of flow and the paraffin and salt content of the crude oil results in the deposition of scale, deposits and paraffin clogging of the downhole oil string casing which is detected at the surface by drops in the pressure gauge 54 at the surface.

The clogging of the oil string casing 12 is fostered by not only the salt constituents of the crude oil but also by the paraffin content of the crude oil together with temperature gradient existing between layers of the earth from the oil downhole to the surface. The clogging of the downhole oil string casing has heretofore required the shut down and maintenance of the oil well by the introduction of hot oil or solvent being pumped down the oil string casing for a sufficient time and in a sufficient quantity to dissolve the paraffin clog in the downhole oil string casing. This maintenance is costly in terms of down time, chemicals and energy required to unclog an oil string which can be prevented by utilizing the novel oil tool 40 of the present invention at various locations in the oil string casing which may be employed together with the standard coupling 38 for joining sections of the oil string together.

Figure 2:
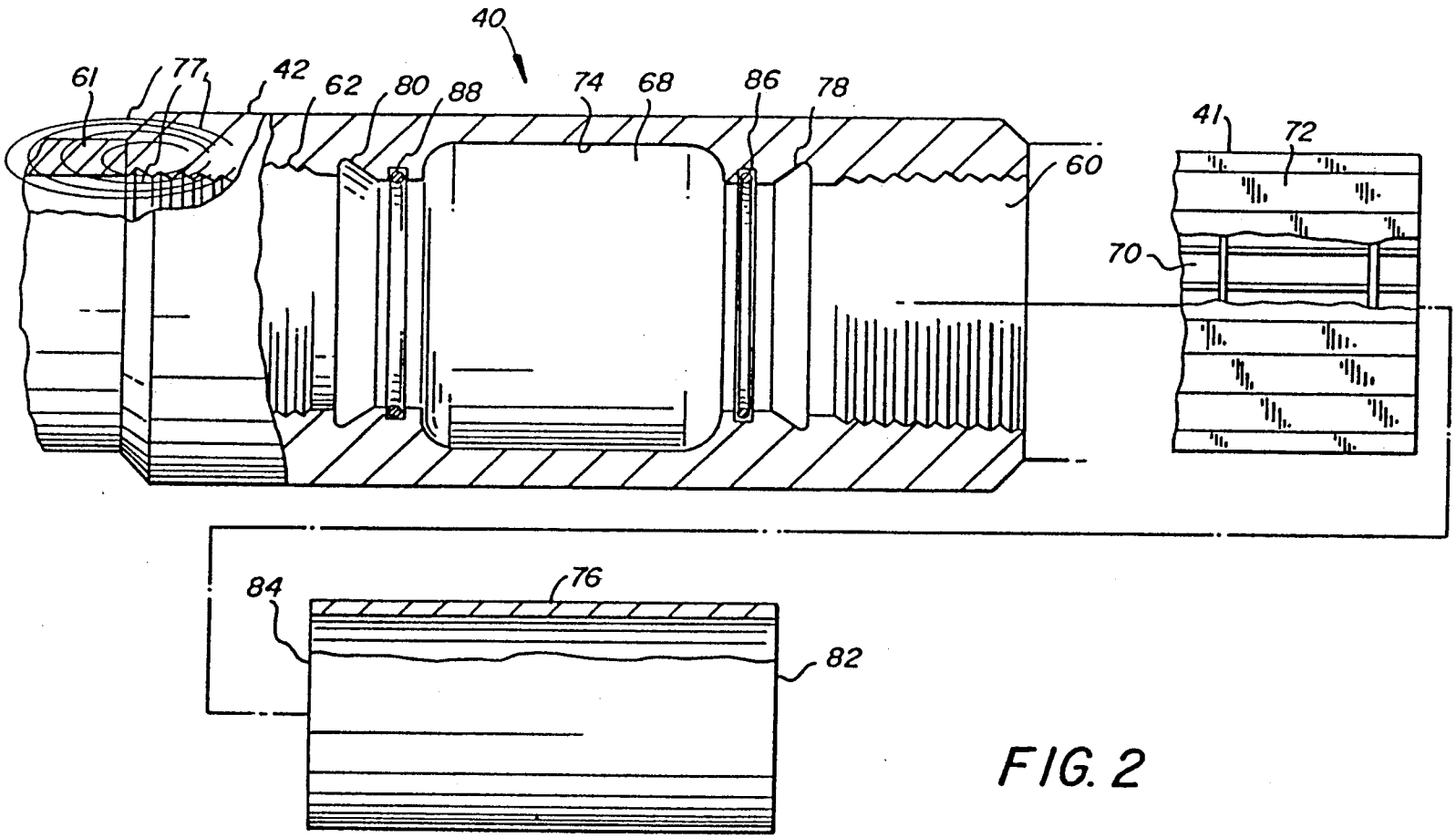
FIG. 2 is an exploded side elevational view partly in section of a novel downhole oil string coupling constructed in accordance with the invention.

The novel downhole oil tool 40 in the preferred embodiment serves the dual function of performing the function as an ordinary coupling for joining sections of oil string pipe together which form the downhole oil string casing while functioning as an oil tool for preventing and dissolving aggregations of the constituents of crude oil that would otherwise clog the oil string casing 12. The novel downhole tool 40 is believed to operate by magnetically inducing charges in salt and paraffin constituents in the crude oil and to disrupt the electrostatic forces resulting from the flow of crude oil in the downhole oil string casing. Referring now to FIGS. 1 and 2 the novel downhole oil tool 40 includes an outside surface 42 includes a pair of threaded ends 60 and 62 for connecting threaded ends of sections of oil string pipe 61 which form the oil string casing 12. The novel oil tool 40 has an outside surface 42 of a diameter which is preferably the same outside diameter as the standard coupling 38.

The oil tool 40 may also be of the same length, shorter or longer than the standard coupling 38 used to join the sections of oil string pipe together to form the oil string casing 12. The novel oil tool 40 may also be of the same material as the standard oil string coupling 38 except that oil tools constructed from couplings with low hang weights of for example under 70,000 pounds are not particularly advantageous at positions in the oil string casing at or near the surface for example at position 66 (FIG. 1) since the weight of the entire oil string casing 12 in deep wells could be greater than the hang weight tolerance limits of the material. It will be recognized that a low hang weight however could be employed for a coupling for an oil tool 40 at position 64 (FIG. 1) in the drill string might be utilized at or near the bottom of the oil string casing in view of the reduced amount of hang weight at position 64.

In the preferred embodiment of the invention oil tools are formed from materials having a hang weight of 100,000 pounds or greater such as L80 and N80 or P105 as described in the Specification on Performance Properties of Casing, Tubing and Drill Pipe of the American Petroleum Institute Standards. These standards will be revised in the future as new materials are available having hang weights in excess of 200,000 pounds are available and as new materials become available having greater weights. The invention contemplates the use of these materials since the material of the present oil tool employs the same materials as the couplings for these pipes for utilization in oil string pipe for deeper oil wells. Materials having the hang weight of J55 which is about 72,000 pounds can be utilized although recent materials having a hang weight of over 200,000 pounds are preferred in view of the fact that the inside diameter of the novel oil tool 40 is reduced to form an annular cavity 68 of increased diameter (FIG. 2) to provide a cavity for a plurality of magnets 70.

The annular cavity or recess 68 reduces the wall thickness from ¼ to ½ an inch (0.64 to 1.27 cm) to make room for the magnets 70 and a magnet restraining and positioning ring 72 which is of a non magnetic material which separates each magnet 70 from the internal wall 74 of the annular cavity 68. The magnets 70 are maintained at a distance from the internal wall 74 of the magnetic metal of the oil tool 40 by the positioning ring 41 which is of a non magnetic material and preferably of aluminum. The decrease in strength resulting from the formation of the annular cavity 68 is offset in part by utilizing materials with greater hang weights such as L80 and N80 which have hang weights of 104,300 pounds and 135,400 pounds respectively and materials such as P105 which have a hang weight of 177,700 pounds.

The decrease in hang weight strength is further partially offset by the insertion and anchoring of an inside liner 76 composed of a non magnetic material and preferably a non magnetic alloy of stainless steel. Stainless steel by itself does not have sufficient hang weight to justify its use in substitution for the material forming the body of the oil tool 40. Non magnetic alloys of stainless steel are also relatively poor conductors of static charges which are believed to assist in the scaling and plugging of oil string casing with paraffin. The inside liner 76 can also be constructed of other non magnetic materials such as plastic or elastomeric materials where the material of the oil tool 40 is selected from a material of a suitable hang weight strength or has a wall of increased thickness to provide a suitable hang weight strength to support the weight resulting from the length of downhole oil string casing 12.

Figure 5:
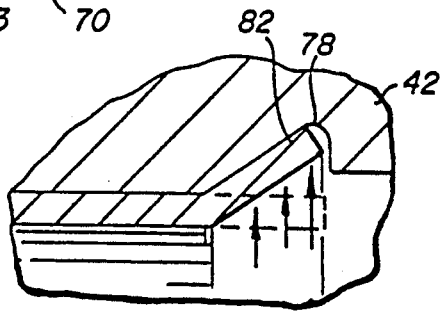
FIG. 5 is an enlarged sectional view of the section of the reference circle of FIG. 3 illustrating a means for securing the non magnetic liner in the novel downhole oil string coupling.

The inside liner 76 is preferably locked in the inside of the oil tool 40 by providing a locking annular recess 78 and 80 at the ends of the oil tool 40 between the threaded portions 60 and 62. The inside liner of a non magnetic material such as stainless steel, copper or other non magnetic metals and alloys may then be compressed at ends 82 and 84 to deform, roll or turn the ends 82 and 84 into the annular recess 78 and 80 by crimping, compressing or increasing the inside diameter of ends 82 and 84 as illustrated in FIG. 5.

A pair of O-ring seals 86 and 88 are provided between annular cavity 68 and locking annular recess 78 and annular cavity 68 and locking annular recess 80 respectively to seal the magnets 70 from the flow of crude oil from inside the oil tool through liner 76 to prevent the introduction of crude oil into cavity 68 to disrupt the propagation of electrostatic forces along the downhole oil string casing 12 and assist in the magnetic induction of paraffin and other materials flowing inside and through oil tool 40. It is believed that the difference in the conductivity of the materials together with the action of magnets 70 are responsible for preventing the clogging of the downhole portions of oil string casing of oil tool 40.

The magnets 70 in annular cavity 68 are preferably magnets having a residual flux density of greater than 2,000 gauss. Magnets utilized in annular cavity 68 are also flat rectangular magnets or curved magnets of minimal height in view of the dimensions of downhole oil string which has an internal diameter of 2 inches or 2½ inches (5.1 to 6.4 cm) depending upon the size and type of pipe used in the downhole oil string. The preferred magnets in accordance with the invention are about 1½ inches long (3.8 cm) by 5/16th of an inch (0.79 cm) by 5/16th of an inch (0.79 cm) and have residual flux densities of over 10,000 gauss. Each of the magnets 70 in the preferred embodiment are flat rectangular magnets with their north pole 71 and south pole 73 aligned in a layer arrangement with the north pole and south pole layered along the 1½ inch length of the magnet 70 as illustrated diagrammatically in FIG. 3 and 4. The magnets 70 are also spaced laterally adjacent to one another with their north pole 71 and south pole 73 facing one another across the path of crude oil flowing through the novel oil tool 40.

The magnetic forces generated by magnets 70 are divided into major forces 152 which are directed across the flow as depicted in FIG. 13 and minor forces 77 (FIGS. 2 and 3) which propagate from the layered magnets 70 through the ends of the oil tool 40 out through the conductive pipe 61 connected to the novel oil tools of the invention. It is believed the minor magnetic forces which extend out along the length of the magnetic pipe together with the non magnetic inner liner and conduit assist in the disruption of the propagation of static charges and the further magnetic action on the constituents of crude oil flowing through the combination of fields provided by oil tools constructed in accordance with the invention.

The magnets 70 may be made of any material of suitable flux density with neodymium magnets being preferred such as neodymium alloy magnets being preferred such as neodymium type 37T and neodymium iron combinations such as neodymium, iron and boron alloy magnets known as NDFe 35 having a residual flux density of 12,200 gauss. These magnets are utilized in combination with the non metallic inside liner work together to charge salts, paraffin and other magnetic materials flowing through the crude oil conduit to prevent their coagulation and scaling of the inside of the downhole oil string line while at the same time interfering with frictional and the propagation of electrical static forces which are believed to contribute to the scaling and clogging of crude oil transmission lines.

The novel oil tool of the invention may be utilized in the downhole oil string at every 1,000 (304.8 meters) or 1,500 feet (457.2 meters) or more to prevent the clogging of the oil string depending upon the paraffin and salt consistency of the pumped crude oil. The tool once in place of the ordinary coupling requires no maintenance since the magnets are effective in charging particles flowing through the inside liner 76 of the oil tool and lose only 5% of their effectiveness in 100 years. The neodymium, iron, and boron content of magnets utilized in accordance with the invention coupled with the preferred liner of a non magnetic stainless steel is also maintenance free while assuring the constant production of crude oil by preventing the down time, maintenance, chemicals and other problems associated with clogged downhole oil lines.

The stainless steel alloys utilized for the inside liner 76 are preferably a non magnetic alloy of stainless steel or other non magnetic material to not interfere with the magnetic forces generated by the magnets upon salts, paraffin and other constituents of crude oil flowing through the inside liner 76. The magnets 70 are also increased in their effectiveness by the utilization of a magnetic shield provided around the magnets or the spacing of the magnets 70 away from the magnetic body of the oil tool 40 together with the non magnetic positioning ring 72 which may be aluminum or elastomeric material to dampen the transmission of vibrational forces in oil string casing 12 in oil tool 40.

Figure 3:
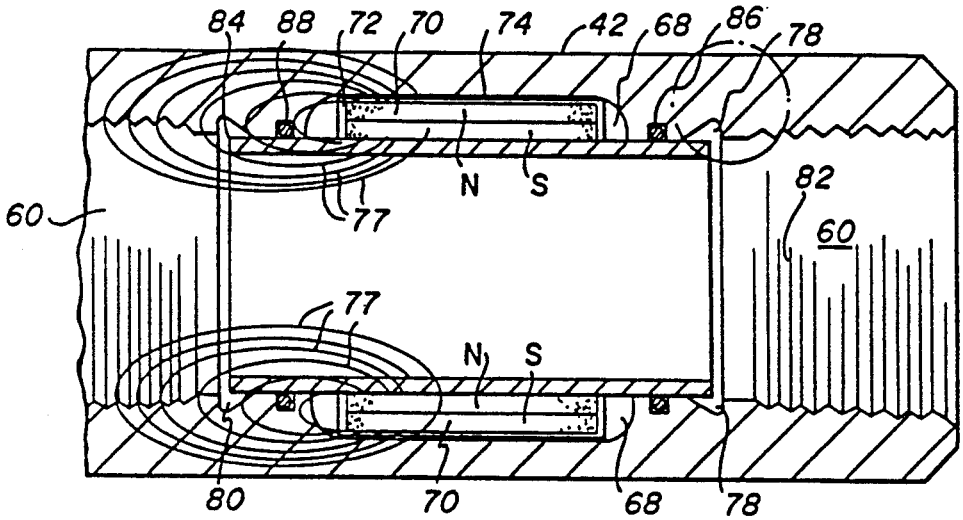
FIG. 3 is a cross sectional view of the downhole oil string coupling of FIG. 2 illustrating the arrangement of the components in a preferred embodiment.
Figure 4:
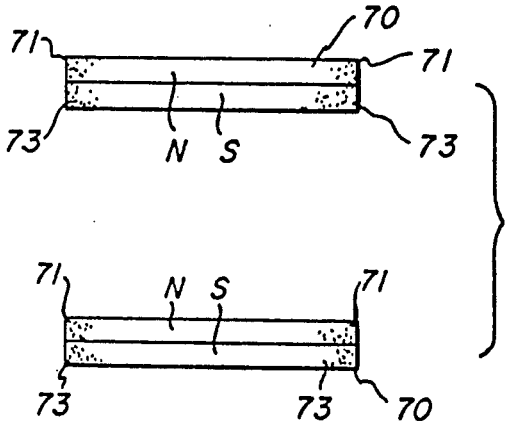
FIG. 4 is a side elevational view illustrating the arrangement of the north and south poles of magnets utilized in oil tools constructed in accordance with a preferred embodiment.

As heretofore discussed the magnets 70 are maintained away from contact with the walls of the annular cavity 68 to direct their magnetic forces upon the crude oil flowing through the inside liner 76 and in the preferred embodiment the magnets 70 are arranged in radial non alignment. As indicated in FIGS. 3 and 4 magnets 70 have their north pole 71 oriented for example in the direction of flow of crude oil whereas the laterally adjacent magnet 70 has its south pole oriented in the direction of the flow of crude oil. It is believed the preferred arrangement of the laterally adjacent magnets having a layer of north and south poles facing one another across the path of flow of crude oil through the inner liner 76 assists in the induction of magnetic forces in particles flowing through the liner and disrupts the propagation of electrostatic forces along the outside of the outside surface 42 of the oil string casing 12 that are believed to promote the scaling and clogging of oil flow lines.

The plugging and scaling of oil string casing 12 occurs not only downhole in oil string casing 12 but also above ground from the pumping tee 26 through the terrain or subterranean oil flow transmission lines 100. The above ground oil transmission lines 100 from the well head to the storage tank or refinery also become plugged and clogged with paraffin due to the same electrostatic frictional forces and temperature variation in the environment as were encountered in the downhole oil string. These flow lines from the well head to the refinery or storage area may be either terrain or subterranean oil conduits but generally are oil lines which horizontally follow the surface of the earth to the storage facility or refinery.

These flow lines like the downhole oil string lines become clogged and require maintenance to unplug the line by utilizing either hot oil, hot solvents or chemicals which are potentially environmentally dangerous when oil flow lines are broken or when the solvents are subsequently removed and discarded from the crude oil in the refining process. It has been found the problems of plugging and clogging of oil flow lines like the plugging and clogging of downhole oil strings can be solved by the utilization of oil tools constructed in accordance with the invention. These oil tools employ the same principals of magnetism and disruption of the electrostatic forces resulting from the frictional forces of the oil flowing through the oil flow line to remove and prevent the scaling and paraffin clogging of the oil flow lines.

Figure 6:
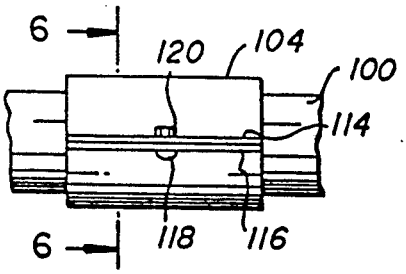
FIG. 6 is a side elevational view of a flow line oil tool constructed in accordance with the invention and attached to a non magnetic section of a flow line.
Figure 7:
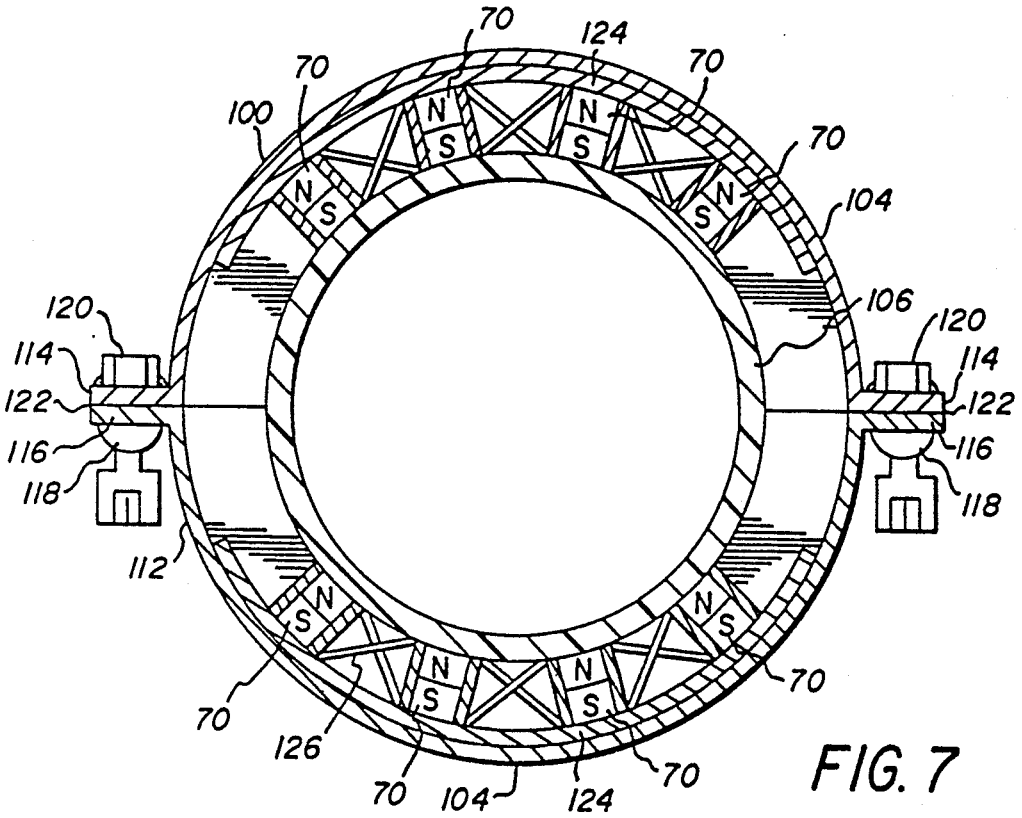
FIG. 7 is an enlarged side elevational view taken along the line 6—6 of the novel flow line oil tool of FIG. 6.

Referring now to FIGS. 6 and 7 an oil flow tool 102 is illustrated having an environmental coating or covering 104 which may be composed of a non magnetic and fairly non conductive alloy of stainless steel. Environmental coating 104 could also be constructed of other non magnetic materials such as plastic, elastomeric materials or other non magnetic metal alloys for environmentally protecting the components of the novel oil tool 102.

Oil tool 102 is constructed in the form of a sleeve that is about 3½ inches (8.9 cm) to about 4 inches (10.2 cm) long designed to fit around a section of non magnetic plastic pipe 106 non magnetic stainless steel or other non magnetic section of conduit in existing oil flow transmission lines or added between sections of magnetic pipe. Alternatively oil tool 102 may be a unitary sleeve (FIGS. 8 and 9) having an internal conduit 108 having threaded ends 107 and 109 for connection or splicing between two sections of magnetic oil flow lines.

In the preferred embodiment the flow line oil tool is constructed in two halves 110 and 112 with each of the halves containing the same components which halves 110 and 112 can be separated or pivoted apart by a hinge to allow the two halves to be fixed around an existing non magnetic section of flow line pipe. The environmental covering 104 can terminate in fastening tabs 114 and 116 for connecting each of the two halves together through bolts 118 having suitable locking means 120. The halves 110 and 112 may further be positioned with respect to one another through the utilization of shims or washers 122 to assist in the fitting and securement of the oil tool 104 around existing section of non magnetic pipe.

The flow line oil tool 102 includes a pair of highly magnetic steel shields 124 along with a plurality of magnets 70 are disposed in contact with each of the magnetic shields 124. The magnets 70 are restrained and positioned with respect to each of the magnetic shields 124 by a pair of non magnetic holding means 126. The concave side of the magnetic shields includes the plurality of magnets 70 having a layer of north pole and south pole as illustrated and discussed with respect to FIG. 4. The plurality of magnets 70 may be the same neodymium, iron, boron allow magnets or other magnets having a suitable flux density as discussed with respect to the downhole coupling and may be instead of 1½ inches (3.81 cm) long or 3 inches (7.62 cm) long and positioned with their north and south poles laterally positioned with respect to each other in each of the halves 110 and 112 by magnetic holding means 126.

Figure 8:
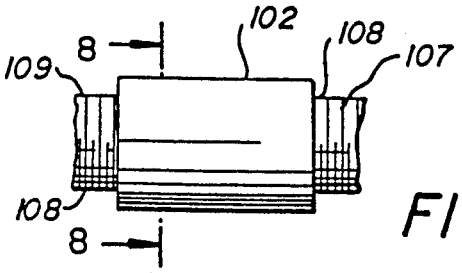
FIG. 8 is a side elevational view of an alternative embodiment of a flow line oil tool including a section of non magnetic conduit constructed in accordance with the invention.
Figure 9:
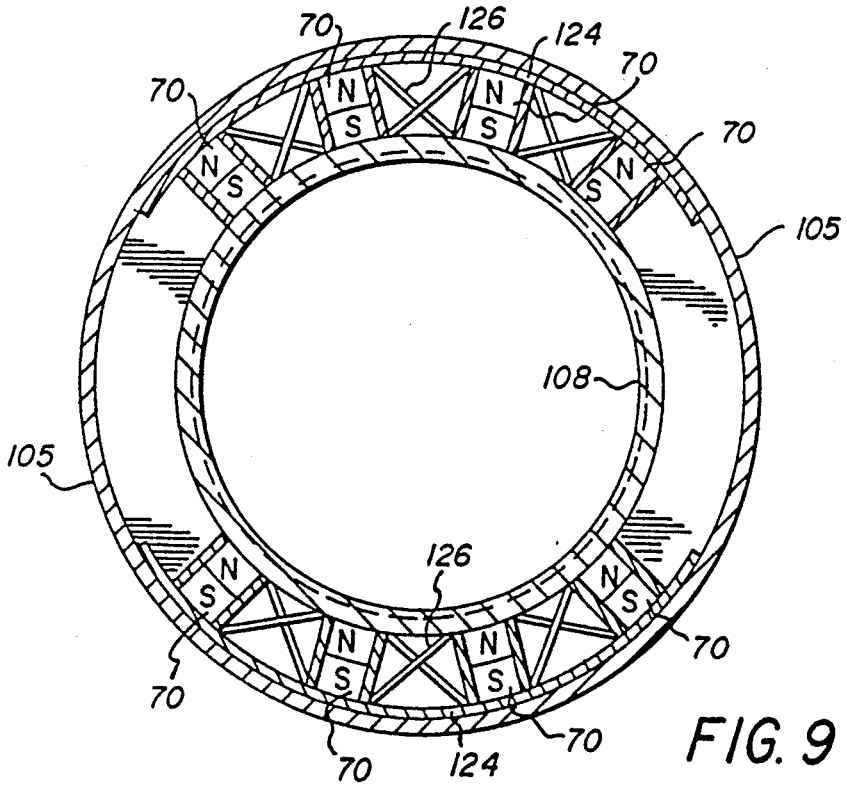
FIG. 9 is an enlarged side elevational view taken along the line 8—8 of the novel flow line oil tool of FIG. 8.

The embodiment of the flow line oil tool as illustrated in FIGS. 8 and 9 include many of the same components except the oil tool in FIGS. 8 and 9 include a section of the non magnetic conduit for connection to a magnetic oil flow line. The flow line oil tool includes an outer covering 105 of a non magnetic metal alloy or a non magnetic plastic or elastomeric material. Otherwise the oil tool of FIGS. 8 and 9 includes a pair of magnetic shields 124, magnets 70 arranged as in FIG. 7 and a pair of non magnetic holding means 126.

This arrangement of magnets, magnetic shields and non magnetic conduit for the transportation of crude oil operates to induce magnetic charges in the crude oil petroleum constituents to prevent their scaling and clogging the oil line in the manner as heretofore described. The combination of the shield plus magnets non magnetic outer covering and section of non magnetic pipe are also believed to serve as a means for disrupting the electrostatic charges resulting from the flow of crude oil in the oil flow pipe line and discharge the static forces that would otherwise build up along the length of the pipe and result in the attractive forces between the walls of the pipe and ionic particles in the crude oil to result in the paraffin clogging of the oil flow line.

The principals of the operation of the downhole oil tool and the flow line oil tool are the same in effecting the magnetic and electrostatic forces in the constituents of the crude oil. These forces are best dispelled with a plurality of magnets disposed axially along the length of a section of non magnetic conduit. The number of magnets utilized depend upon the diameter of the oil flow lines and preferably are 2 to 6 pairs of magnets for conduits of up to 3 inches in diameter and 4 to 12 or more pairs of magnets for pipes of larger diameter.

Figure 10:
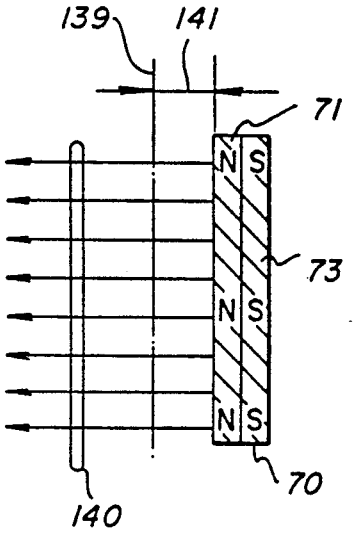
FIG. 10 is a schematic view of magnetic flow line forces directed to crude oil constituents flowing in oil lines when a magnetic backing is not utilized.
Figure 11:
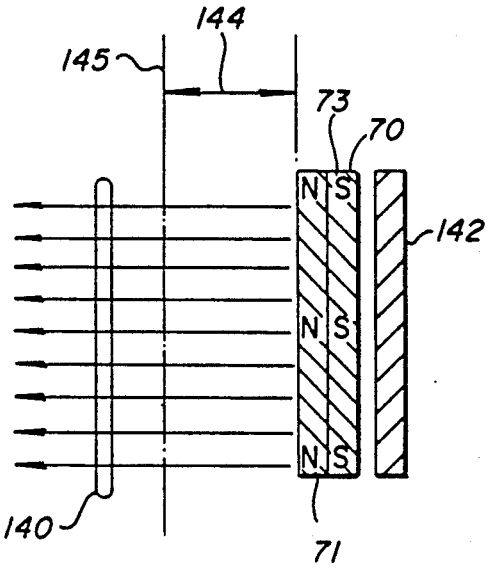
FIG. 11 is a schematic view of magnetic flow line forces directed to crude oil constituents flowing in oil lines when a magnetic backing is utilized.

The magnetic forces believed responsible for preventing the scaling and build up of constituents of crude oil flowing through crude oil conduits are illustrated in FIGS. 10 to 13. In FIG. 10 lines of force 140 are illustrated as exerting a force of a given magnitude represented by line 139 at a distance represented by arrow 141 from magnet 70 in FIG. 10. The application of a magnetic backing 142 to magnet 70 exerts the same magnitude of force at line 145 at a much greater distance as represented by line 144 demonstrating the increase on the power of the magnets by the addition of a magnetic shield 124.

Figure 12:
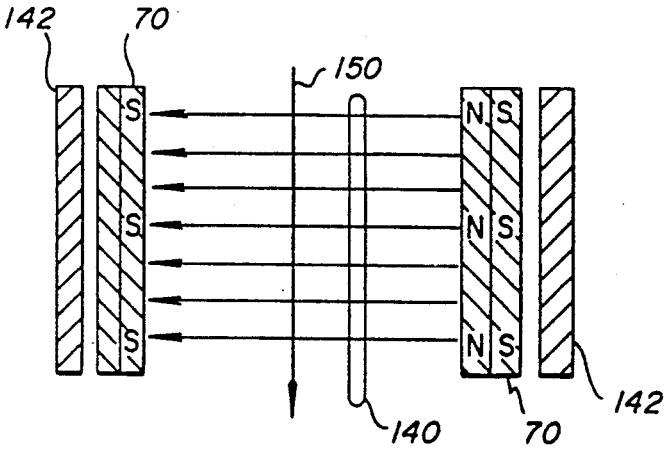
FIG. 12 is a schematic view of magnetic flow line forces directed to crude oil constituents flowing in oil lines where opposing magnets and steel backing is utilized.

Referring to FIG. 12 the arrangement of magnets 70 laterally disposed with respect to one another is schematically illustrated. The lines of force 140 between magnets 70 with a pair of magnetic shields is illustrated in relation to the flow path of crude oil as represented by line 150. The non magnetic inner liner does not impede the magnetic forces directed across the path of flow of the constituents of the crude oil. As illustrated in FIG. 13 the utilization of a plurality of magnets 70 around a non magnetic inner liner 76 or a section of non magnetic conduit 100 direct the lines of force 152 substantially across the path of crude oil flowing in the conduit to the magnet disposed on the opposite side of the pipe. It will be understood that while even pairs of magnets have been described it is possible to employ odd numbers of magnets to obtain the advantages of the invention. It will be further understood the steel backing addition to the magnets 70 further concentrate the force of the magnets 70 and 92 upon the crude oil flowing through the oil conduit. It is believed that the force of the magnetic field assists in the polarization of the constituents in crude oil along with the resonance effect which both prevents and dislodges paraffin build up in pipe lines.

The effectiveness of the present system for removing and preventing paraffin clogging of oil conduits is demonstrated in FIG. 14 which is a schematic diagram cf oil flow line having paraffin build up problems from oil wells producing crude oil in Wyoming. The paraffin build up inside the flow lines prior to the introduction of the oil tools of the present invention resulted in high flow line pressures requiring the injection of paraffin chemicals solvents at three locations at a rate of 2 quarts per day at each site. These chemical treatments had been previously required to prevent paraffin clogging and maintain pump pressure in the normal range. The normal pressure in the flow lines varied from between 35 pounds to 65 pounds before the use of the paraffin control oil tools of the invention.

Prior to the application of oil flow oil tools constructed in accordance with FIG. 7 of the invention to the oil flow line illustrated diagrammatically in FIG. 14 all chemical paraffin solvent injection was discontinued during the period of the test. The novel downhole oil tool were not utilized but only the above ground oil flow line oil tools were employed so that paraffin build up in the oil string was not controlled for purposes of the test. The seven oil wells 6-18, 7-18, 8-18, 9-18, 10-18. 8-19 and 9-19 are illustrated as circles on the diagrammatic oil flow line along with the distances between various sections of pipe illustrated in feet along the sides of the oil flow lines. The flow line oil tool units were disposed in eight locations 160, 162, 164, 166, 168, 170, 172 and 174 with some of the units 160, 162, and 174 located near the surface of the oil well. The pump pressures were monitored in the flow lines to determine whether paraffin was building up in the flow lines after the use of chemical solvents ceased. The results of the test are reported below in Table I.

TABLE I

DATE 5-11-89 ALL CHEMICAL INJECTION STOPPED.

| | PRESSURES ON DATE | | |
|---|---|---|---|
| WELL | 05/11/89 | 05/12/89 | 06/12/89 |
| 6-18 | 65 lbs. | 110 lbs. | 45 lbs. |
| 7-18 | 55 lbs. | 50 lbs. | 45 lbs. |
| 8-18 | 45 lbs. | 35 lbs. | 35 lbs. |
| 9-18 | 65 lbs. | 120 lbs. | 45 lbs. |
| 10-18 | 35 lbs. | 40 lbs. | 35 lbs. |
| 8-19 | 40 lbs. | 40 lbs. | 35 lbs. |
| 9-19 | 35 lbs. | 32 lbs. | 30 lbs. |

As previously indicated, the control of paraffin downhole was not controlled utilizing downhole oil tools constructed in accordance with FIGS. 2 and 3. The paraffin coagulation and aggregation noted at wells 6-18 and 9-18 on 05/12/89 may have partially resulted from paraffin coagulation starting in the downhole oil string casing as it was being pumped from the ground to the surface since paraffin coagulation was not controlled until the paraffin reached the surface. It is believed these increases but then the subsequent decrease in pump pressures to normal on well 6-18 and well 9-18 were the result of paraffin formations being brought to the surface and subsequently breaking loose and being dissolved or dislodged from the walls of the flow line which resulted in an increase in pressure the first day after the installation of the paraffin units. Thereafter the pressures dropped and remained within the pump pressure normal tolerance limits for the 30 day test period as indicated in Table I.

It is believed paraffin coagulation was arrested by the introduction of the flow line oil tool units as a result of the action of the magnets upon the constituents of crude oil bearing salts and paraffin elements together with the use of materials differing from the material of the conduit flow line and more particularly materials that are non magnetic and/or less electrically conductive than the flow line or downhole oil conduit so that propagation of electrostatic charges along the oil conduit are broken to prevent the subsequent build up of sufficient forces to result in scaling and paraffin blockage of the oil conduit. It is believed the electrostatic forces can be interrupted in various procedures alone or together with the utilization of magnets and dissimilar materials to prevent the propagation of electrostatic forces resulting from the flow of crude oil in a crude oil conduit.

The novel oil tools of the present invention provide significant advantages over prior art methods and tools for removing paraffin and unclogging oil conduits such as the use of chemicals, hot oils and solvent treatments which require the shut down and maintenance of the oil conduit. These procedures not only interfere with the normal operation of the equipment but also interfere with the production capabilities and transportation capabilities of the oil line. In addition the utilization of oil tools constructed in accordance with the invention for preventing the clogging of oil conduits provides a low cost, low maintenance and an environmentally attractive alternative to solvents which have to be removed, which are expensive and which present environmental problems of disposal when they escape to the environment as a result of breakage of the oil pipe line. The method of the invention further allows a great degree of adaptability depending upon the paraffin content of the oil and the disposition of the oil tool along the downhole oil string as well as in the terrain and subterranean flow line to increase the production of oil by decreasing the down time resulting from the clogging of oil conduits.

The novel oil tools of the invention may be readily modified by providing virtually an unlimited application to various types of pipe fittings such as curved or T shaped joints, valves and other components utilized in pipelines where paraffin build up and scaling present problems. It is therefore understood that the present invention can be applied to T shaped joints, valves and other pipeline components together with the utilization of various means for removing electrical charges or interfering with electrical charges that might otherwise result in the concentration and build up of salts, paraffin and other components of crude oil in oil conduits which result in clogging.

It will also be appreciated by those skilled in the art that the invention may be implemented in a variety of ways to prevent paraffin build up or settling from crude oil once the magnetically induced effect on the particles have been dissipated such as when the crude oil is placed in storage facilities or containers. In such applications the method of the present invention contemplates the movement of crude oil by circulation pumping through novel oil tools constructed in accordance with the invention to maintain the components of crude oil in suspension until the crude oil has been refined.

Those skilled in the art will further recognize the invention has a wide range of applicability to various oil flow circulation systems to prevent the coagulation, settling and deposition of paraffin, scale and other constituents of crude oil prior to refining without the use of chemical treatments, solvents, back washing or hot oil or water treatments which are time consuming and many times interrupt the normal production or flow of oil. It will be further understood the invention may be implemented in a variety of ways to suit the particular applications of the novel oil tools of the invention to downhole applications and above ground flow lines to, suit the particular requirements of the oil conduit either above ground or below ground so as to provide the advantages inherent in the combination of magnets and non magnetic material to interrupt the static forces propagating electrostatic charges while magnetically inducing and influencing the particles and constituents of crude oil flowing through an oil pipeline. Consequently it is intended that these and other modifications and applications of the invention to a variety of systems may be made within the spirit and scope of the invention as defined in the following claims.

What is claimed is:

1. An oil tool for controlling paraffin related clogging in flow lines comprising:

(a) a substantially cylindrical sleeve having a first end and a second end providing an environmentally resistant outside covering and means in said first end and said second end for connection to an oil flow pipe line;

(b) a curved magnetic shield axially aligned with said substantially cylindrical sleeve and disposed intermediate said first end and said second end of said substantially cylindrical sleeve;

(c) at least one magnet disposed longitudinally inside said substantially cylindrical sleeve in axial alignment with said substantially cylindrical sleeve and said curved magnetic shield;

(d) a liner having a first end and a second end disposed intermediate said first end and said second end of said substantially cylindrical sleeve; and (e) means for sealing said liner intermediate said first end and said second end of said substantially cylindrical sleeve.

2. The oil tool of claim 1 wherein said environmentally resistant covering of said sleeve has a hang weight of at least 70,000 pounds.

3. The oil tool of claim 2 wherein said curved magnetic shield is formed in said substantially cylindrical sleeve by increasing the internal diameter of said substantially cylindrical sleeve intermediate the ends thereof.

4. The oil tool of claim 3 further comprising a spacing element for positioning said at least one magnet between said curved magnetic shield and said substantially cylindrical sleeve.

5. The oil tool of claim 4 wherein said liner is a non conductive liner disposed intermediate the ends of said substantially cylindrical sleeve.

6. The oil tool of claim 5 further comprising a seal disposed between said non conductive liner and said substantially cylindrical sleeve.

7. The oil tool of claim 2 further comprising at least two magnets wherein each of said at least two magnets have a north pole disposed longitudinally along the length of each magnet and a south pole disposed longitudinally adjacent to said north pole along the length of said magnet and said magnets are arranged with the north and south poles facing each other across the internal diameter of said substantially cylindrical sleeve.

8. The oil tool of claim 1 wherein said substantially cylindrical sleeve includes a plurality of magnets in axial alignment with said substantially cylindrical sleeve.

9. The oil tool of claim 8 wherein each of said magnets has a residual flux density of at least 2000.

10. The oil tool of claim 9 wherein said magnets are composed of an alloy of neodymium.

11. The oil tool of claim 10 wherein each of said magnets has a residual flux density of 12,200.

12. An oil tool for controlling clogging comprising:

(a) a coupling having two ends and a section of increased internal diameter disposed intermediate said two ends;

(b) at least one magnet disposed in said section of increased internal diameter;

(c) a non magnetic liner having a first end and a second end disposed intermediate said two ends of said coupling and bridging said section of increased internal diameter of said coupling; and (d) a means for sealing said non magnetic liner from said section of increased internal diameter of said coupling.

13. The oil tool of claim 14 further comprising a plurality of magnets disposed in said section of increased internal diameter.

14. The oil tool of claim 13 further comprising a non magnetic positioning ring for holding said plurality of magnets and maintaining said plurality of magnets spaced away from contacting the internal wall of said coupling.

15. The oil tool of claim 14 wherein each magnet of said plurality of magnets have a north pole disposed longitudinally adjacent to said north pole along the length of said magnet.

16. The oil tool of claim 15 wherein each of said plurality of magnets have a residual flux density of greater than 2,000 gauss.

17. The oil tool of claim 16 wherein each of said plurality of magnets have a residual flux density of greater than 12,000 gauss.

18. The oil tool of claim 15 wherein said plurality of magnets are selected from the group consisting of Cast Alnico V, Sintered Alnico V, Samarium Cobalt 26, Neodymium Iron 30H, and Neodymium Iron 35.

19. The oil tool of claim 17 wherein each of said plurality of magnets are about 1½ inches long (3.81 cm) and have a square cross section of about 0.25 inches (0.64 cm) and are composed of a neodymium and iron alloy.

20. The oil tool of claim 14 wherein said coupling has a hang weight of greater than 70,000 pounds.

21. The oil tool of claim 20 wherein said two ends of said coupling are threaded for connection to the ends of an oil string line.

22. The oil tool of claim 21 wherein said coupling has a hang weight of greater than 100,000 pounds.

23. The oil tool of claim 21 wherein said non magnetic liner is composed of a non magnetic alloy cf stainless steel.

24. The oil tool of claim 21 wherein said means for sealing said non magnetic liner from said section of increased internal diameter is a first seal and a second seal which are composed of elastomeric O-rings.

25. The oil tool of claim 21 wherein said coupling further comprises a pair of annular recesses disposed intermediate the ends of said coupling and said non magnetic liner for securing said non magnetic liner in place in said coupling by deforming said non magnetic liner into said pair of annular recesses.

26. The oil tool of claim 21 wherein said coupling is about 10 inches (25.4 cm) in length.

27. The oil tool of claim 21 wherein said section of increased diameter is about 0.5 inches (1.27 cm).

28. A method for controlling paraffin related clogging of oil lines comprising:

(a) positioning sections of a non magnetic or electrically less conductive piping in between sections of an oil flow line composed of a magnetic or conductive material;

(b) surrounding said sections of non magnetic or electrically less conductive piping with at least one magnetic to influence the magnetic susceptibility of paraffin and salts suspended in the flow of crude oil in said oil flow line; and (c) covering said at least one magnetic with a magnetic and conductive piping to increase the magnetic power of said magnet.

29. The method for controlling paraffin of claim 28 wherein said positioning of sections of a non magnetic or electrically less conductive piping is on the downhole oil string casing.

30. The method for controlling paraffin of claim 28 wherein said positioning of sections of a non magnetic or electrically less conductive piping is on an oil flow line.

31. The method for controlling paraffin of claim 30 wherein said non magnetic line is composed of a non conductive plastic material.

32. The method for controlling paraffin of claim 30 wherein said non magnetic line is a non magnetic alloy of stainless steel.

33. The method for controlling paraffin of claim 30 further comprising utilizing a plurality of magnets axially arranged around two axial halves of said sections of non magnetic or electrically less conductive piping.

34. The method for controlling paraffin of claim 33 wherein each magnet of said plurality of magnets have a north pole disposed longitudinally along the length of said magnet and a south pole disposed longitudinally adjacent to said north pole along the length of said magnet.

35. The method for controlling paraffin of claim 28 wherein said step of covering said at least one magnet is achieved with a steel magnetic and conductive piping.

36. An oil for controlling clogging comprising:

(a) a coupling having two ends and as section of increased internal diameter disposed intermediate said two ends;

(b) at least one magnet disposed in said section of increased internal diameter;

(c) a liner having a first end and a second end disposed intermediate said two ends of said coupling and bridging said section of increased internal diameter of said coupling; and (d) a means for sealing said liner from said section of increased internal diameter of said coupling.

* * * * *